US006754453B2

(12) United States Patent
Siegel et al.

(10) Patent No.: US 6,754,453 B2
(45) Date of Patent: Jun. 22, 2004

(54) METHOD FOR ASSESSING AN END OF LIFE IN A DOCUMENT PROCESSING SYSTEM

(75) Inventors: Robert P. Siegel, Penfield, NY (US); Tracy E. Thieret, Webster, NY (US)

(73) Assignee: Xerox Corporation, Stamford, CT (US)

( * ) Notice: Subject to any disclaimer, the term of this patent is extended or adjusted under 35 U.S.C. 154(b) by 398 days.

(21) Appl. No.: 10/029,346

(22) Filed: Dec. 28, 2001

(65) Prior Publication Data

US 2003/0123077 A1 Jul. 3, 2003

(51) Int. Cl.[7] ..... G03G 15/00; G03G 21/00
(52) U.S. Cl. ..... 399/24
(58) Field of Search ..... 399/9, 24, 25, 399/26, 27

(56) References Cited

U.S. PATENT DOCUMENTS 4,496,237 A 1/1985 Schron ..... 355/14 C
5,349,377 A * 9/1994 Gilliland et al. ..... 399/181
5,717,974 A * 2/1998 Park ..... 399/24
6,108,499 A * 8/2000 Cernusak ..... 399/26
6,606,462 B2 * 8/2003 Siegel et al. ..... 399/24
6,633,732 B2 * 10/2003 Siegel et al. ..... 399/24
6,704,524 B2 * 3/2004 Matsuguma et al. ..... 399/24

OTHER PUBLICATIONS

Robert P. Siegel et al., U.S. Ser. No. unassigned, "Reliability Model Based Copy Count Correction During System Recovery for Predictive Diagnostics" (D/A0138Q).

* cited by examiner

*Primary Examiner*—Fred L Braun
(74) *Attorney, Agent, or Firm*—Christopher D. Wait

(57) ABSTRACT

The present invention relates to a method for applying usage or weighting factors to static cycle counts or "clicks" as tallied in a document processing system. The application of weighting factors to a system cycle count when suitably summed will provide superior measure of the wear to a replaceable element as well as improved indication for the determination of the end of life for a replaceable element in that system. As such the more timely service or substitution for that replaceable element in the system can be provided, thereby allowing costs and service down-time to be minimized.

26 Claims, 2 Drawing Sheets

METHOD FOR ASSESSING AN END OF LIFE IN A DOCUMENT PROCESSING SYSTEM

Cross reference is made to patent application Ser. No. 10/029,330 with the same inventors as present here, which is herein incorporated in its entirety for its teachings, and for which there is common assignment with the present application to the Xerox Corporation.

BACKGROUND OF THE INVENTION AND MATERIAL DISCLOSURE STATEMENT

The present invention relates generally to the reliability of a replaceable element in a complex system. The invention relates more importantly to the life remaining for a replaceable element so that timely replacement may be made without unduly increasing operation costs resulting from too early a replacement or in the alternative a parts failure from waiting too long to replace. The invention relates in particular with regards high frequency service items (HFSI) and customer replaceable units (CRU). The invention relates, more particularly, to using counters to determine replacement of HFSI and CRU in document processing systems.

Current day machine architecture allows for the use of HFSI counters, which keep track of the number of copies/prints that utilize certain key components in a document processing system and, thus, contribute to their wear. There are a number of these counters typically each associated with a particular replaceable element so that they can be reset independently when, for example, a photoreceptor is replaced. Many replaceable parts have such a counter associated with them. They are useful in a service strategy where the individual part is scheduled for replacement when the counter associated with that part reaches a predetermined value (the "life" of the part). The idea is to replace parts just before they fail so as to avoid unnecessary machine down time and loss of productivity. When the part is replaced, the associated HFSI counter is reset to zero. These predetermined values are obtained by examination of a population of the parts in question, determining the mean time between failure, and a judgment on the expected life of the part is made. This judgment targets the replacement of the part just before the average life of the part as measured in "clicks" has transpired. By "clicks" what is meant is the number of iterations of system cycles—usually the number of prints/copies made in a document processing system for example. The problem here is that this judgment needs to provide a conservative estimate of life so that the part does not fail before the scheduled replacement date which means that a certain measure of useful life is being wasted.

The counters are also implemented in a way that the specific counts are only incremented when the pertinent features are being utilized. So in a copier or printer, for example, any counters associated with Tray 2 are not incremented when only Tray 1 is being used. Each part so designated has its own counter.

In U.S. Pat. No. 4,496,237 to Schron, the invention described discloses a reproduction machine having a non-volatile memory for storing indications of machine consumable usage such as photoreceptor, exposure lamp and developer, and an alphanumeric display for displaying indications of such usage. In operation, a menu of categories of machine components is first scrolled on the alphanumeric display. Scrolling is provided by repetitive actuation of a scrolling switch. Having selected a desired category of components to be monitored by appropriate keyboard entry, the sub-components of the selected category can be scrolled on the display. In this manner, the status of various consumables can be monitored and appropriate instructions displayed for replacement. In another feature, the same information on the alphanumeric display can be remotely transmitted. The above is herein incorporated by reference in its entirety for its teaching.

The difficulty with the current scenario is that "clicks" alone are not an accurate measure of the wear experienced by system components. The use of a simple, non-specific, incremental value to track the wear on all components does not acknowledge the specific stresses that each individual component faces and, thus, is inaccurate in assessing the remaining life available for the part. One "click" will correspond to different wear increments for different parts. There are many situations where a part is exercised much more than the click count would indicate and some where it is exercised less. When the HFSI counter is grossly inaccurate on the low side, parts are considered OK when in fact their useful life has expired. The part fails and the device becomes inoperable and unproductive until the customer service engineer arrives, identifies the failure, and repairs the machine. If the estimate is too high, the part is replaced even though it has a measure of useful life remaining. Either case leads to inefficiencies in the parts replacement strategy and incurs increased costs thereby.

Therefore, as discussed above, there exists a need for an arrangement and methodology which will solve the problem of preventing machine system down time without unnecessarily incurring costs from too early or too late a replacement. Thus, it would be desirable to solve this and other deficiencies and disadvantages as discussed above with an improved methodology for more accurately accounting and monitoring wear characteristics in complex systems.

The present invention relates to a method for assessing an end of life determination for a replaceable element in a system, the method steps comprising, accepting a system cycle as a nominal count and applying at least one weighting factor to the nominal count to yield at least one weighted count. This is then followed by summing the one or more weighted counts into a supplemental diagnostic counter.

In particular, the present invention relates to a method for assessing end of life determinations for high frequency service items in a document processing system, the method steps comprising, accepting a document processing system cycle as a nominal count and applying at least one weighting factor to the nominal count to yield at least one weighted count. This is followed by summing one or more weighted counts into a supplemental diagnostic counter.

The present invention also relates to a method of assessing end of life determinations for a high frequency service item in a document processing system, the method steps comprising, incrementing a nominal counter by a nominal count for each cycle of the document processing system and applying at least one weighting factor to the nominal count to yield a weighted count. This is followed by summing the nominal count and the weighted count into one or more supplemental diagnostic counters.

DESCRIPTION OF THE INVENTION

By adding sophistication to the software routines that keep track of the usage of high frequency service items (HFSI) parts in a document processing system, we can improve the predictability of these routines. This will reduce the amount of waste and customer dissatisfaction that comes from replacing parts either too early or too late.

System modeling techniques can be used to represent the relative amount of component stress that a given job contains. One example is to keep track of the number of image pitches that actually take place during cycle-up/cycle-down and count them for all of those subsystems that are impacted. Another example is to use pixel counting to determine the area coverage and use that information to scale the count by the proportional amount of stress that it represents.

The predictability of the current approach can be improved if certain operational characteristics are taken into consideration. The broad teaching here is for the use of estimated or model derived print/copy count adjustments to the HFSI counters that can correlate relative stress levels between certain types of machine usage with the expected life of the various machine subsystems. A table listing of example HFSI as found for one example document processing system

| Xerographic | Mechanical |
|---|---|
| BTAC Sensor & Conditioning Lamp | Digital Tower LVPS Filter |
| Preclean Corotron | Fuser Roll Module |
| Preclean Erase lamp | Fuser Roll Module Rebuild (Roll, Fingers, etc.) |
| Cleaner - Brushes & Flicker Bar | Pressure Roll |
| Final Filter Box (lower left) | Pressure Roll Fingers |
| Waste Bottle | Fuser Web (Drop-in Module) |
| Spots Blade | SFM X-port Rolls |
| Charge Scorotron | SFM Shuttle Platen |
| ROS | Static Brushes |
| ESV Sensor | SFM/Finisher Replacement Items |
| Developer Housing | |
| Trickle Waste Bottle | |
| Toner Dispenser | |
| Toner Bottles - @ 2 per | |
| Pre-Transfer Erase Lamp | |
| Pre-Transfer Corotron Cleaning Pad | |
| Pre-Transfer Corotron | |
| Transfer Corotron Cleaning Pad | |
| Transfer Corotron | |
| Detack Corotron Cleaning Pad | |
| Detack Corotron | |
| Transfer Assist Blade | |
| Photoreceptor | |
| Photoreceptor Backer Bar | |
| BOB Cleaner Brush | |
| Fuser Ozone Filter (upper left) | |
| Fuser Dirt Filter (upper left) | |
| Ozone Filter (lower right) | |
| Dirt Filter (lower right) | |
| Developer Cavity Ozone Filter (upper right) | |
| Developer Cavity Dirt Filter (upper right) | |
| Ground Brush | |

It will be abundantly obvious to one skilled in the art that there are many other replaceable elements and system scenarios to which the present invention may be applied and which are not listed in the table above.

Figure 1:
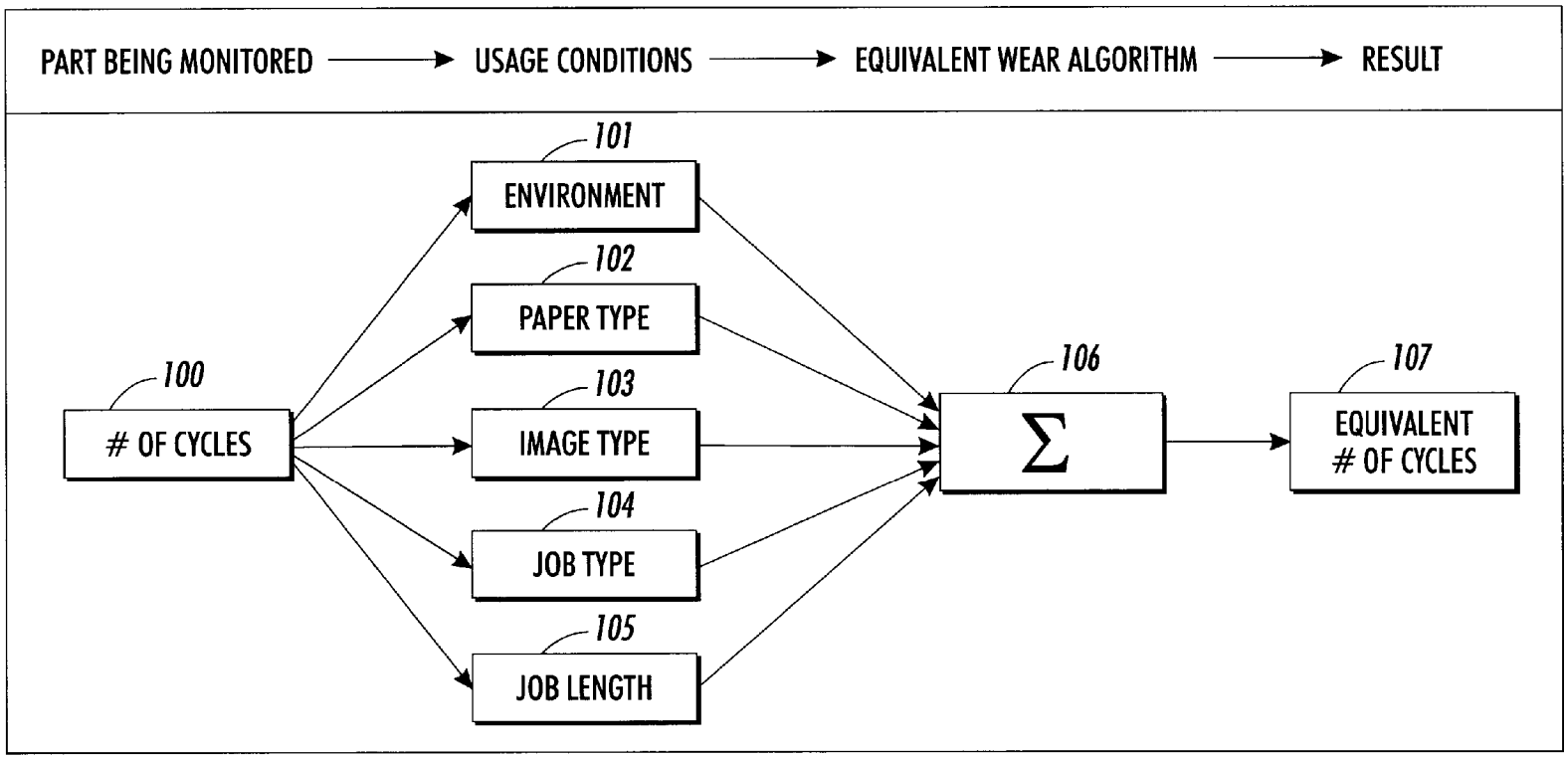
FIG. 1 depicts a flow diagram for the usage conditions and weighting factors for a part being monitored.

FIG. 1 depicts a flow chart with the broad concepts pertaining to the teachings of the present invention. Input block 100 is the number of "clicks" or other incremental count or system input data for a part being monitored as is typically already collected in present prior art systems. Of course, in the alternative, for any input data from the part being monitored that is not currently being collected, a new data collector would need to be implemented. In a copier/printer system, for example, the input data being monitored would typically be the number of copies, although there are many other possible parameters such as operation hours. The input from block 100 is then passed into usage condition weighting blocks 101–105. These weighting conditions for this embodiment comprise usage block 101 environment, block 102 paper type, block 103 image type, block 104 job type, and block 105 job length. Weighting considerations for usage block 101 environment would be parameters of temperature and humidity. The weighting considerations for paper type usage block 102 would be concerned with the media type such as transparencies verses paper, as well as paper thickness and weight. Image type considerations as weighed in at block 103 are toner coverage metrics as determined by examining the incoming image data and in pursuit thereof may be as simple as pixel counting or involve more complex digital imaging manipulation techniques. In usage block 104 job type considerations such as job requirements for simplex/duplex, covers, and inserts, are the weighting factors. Finally, usage block 105 provides a weighting factor as provided for job run length which allows the difference in stress to the system depending upon whether a single page is copied/printed or many copies/prints are generated for a single job. A couple of illustrative examples as found in printer/copier systems follows below.

In electrostatic-graphic printer/copier document processing systems for example, it is a well-known fact that short run jobs are more stressful than long run jobs. One reason for this is the percentage of the total job resources consumed by machine cycle-up and cycle-down. In fact, for very short print/copy length jobs, the cycle-up/down may account for more machine stress than the process of making the prints does. For a typical machine, it is not unusual for 10 or more photoreceptor panels to pass by the transfer zone before the first sheet is fed. During this time, many of the key machine subsystems (e.g. P/R, Developer, and Charge) are being exercised in much the same way that they are during the actual print job. Copy/print quality adjustments may consume many machine resources without contributing to the "click" count input to block 100 at all.

It is important then to count those extra photoreceptor panels as usage for those subsystems rather than relying solely on the sheets fed and printed. So if a given printer/copier machine runs ten blank photoreceptor panels before making the first print, and a customer runs 3 images, the enhanced HFSI counters for those impacted sub-systems would provide for a count of 13 rather than three. The output of usage block 105 will provide a weighted count to account for just such a scenario. Over a long period in which many short run jobs are made, the counts could be quite different than what a simple print counter will show. In the case of a 1000 sheet run, the 10 cycle up copies would be negligible reflecting the relative impact of cycle up in a long run like this is also negligible.

Another usage mode provided for by usage block 103 in the FIG. 1 model is % area coverage. Since the amount of toner on an image can affect the stress on the developer, P/R, cleaner, and fuser, a proportionality factor is used here as well. For example, if a basic text document with 10% area coverage were considered nominal, a pictorial image with 35% coverage would tend to stress those subsystems more. It is unlikely, however, that this document is really 3.5 times as stressful in terms of reliability and wear. Detailed modeling, or empirical data, would provide an influence factor for area coverage. The influence factor would moderate the effect of area coverage by a given percentage. For example, it may be determined that the influence of area coverage is 20% at most. That would mean that from a wear perspective a dark dusting (100% coverage) would generate the equivalent of 2 copy counts per page as shown below:

$$100\%/10\% \times 20\% = 2.0$$

In other words, Actual Coverage/Nominal Coverage multiplied times the Influence Factor would generate the weighting factor that is then the output of usage block 103. It will be apparent to one skilled in the art that embodiment with additional sophistication can be added to this. For example, in another embodiment, not only area coverage, but also density can be included. In a yet a further alternative embodiment, a direct pixel count can be used.

Other stress factors addressed by usage block 102 are paper size and paper weight. There are a number of stresses well known in the printer/copier arts. For example there is the 11" wear mark on fuser rolls. A favorable mix of 14" sheets could actually reduce the stress on the fuser and, thus, independently keeping track of 11" sheets would be beneficial. Heavy weight papers can stress drive elements, requiring more torque. Transparencies can stress fuser rolls because of higher adhesion forces and the higher fusing temperatures required to improve color transparency performance. De-lamination of fuser rolls is a function of the integral of temperature and time and the magnitude of the thermal gradients that the fuser must endure. All these can contribute to the life expectancy calculation of this high cost replacement item as determined in usage block 102.

Returning to FIG. 1, the weighted counts as determined by the weighting factors in the usage blocks 101–105 are combined at summation block 106. In one preferred embodiment as shown at block 107, the resultant summation from summation block 106 is expressed as an equivalent number of system cycles or "clicks" and need not even be a strict integer quantity, as it may comprise a fractional part. The idea is that the customer or field engineer for whom this is provided is most comfortable in determining the need to replace a serviceable unit working within the paradigm of copy counts or "clicks". Furthermore, this representation will be compatible with information systems that deal with replacement intervals in these same terms. However, it will be apparent to those skilled in the art other representations maybe used.

Figure 2:
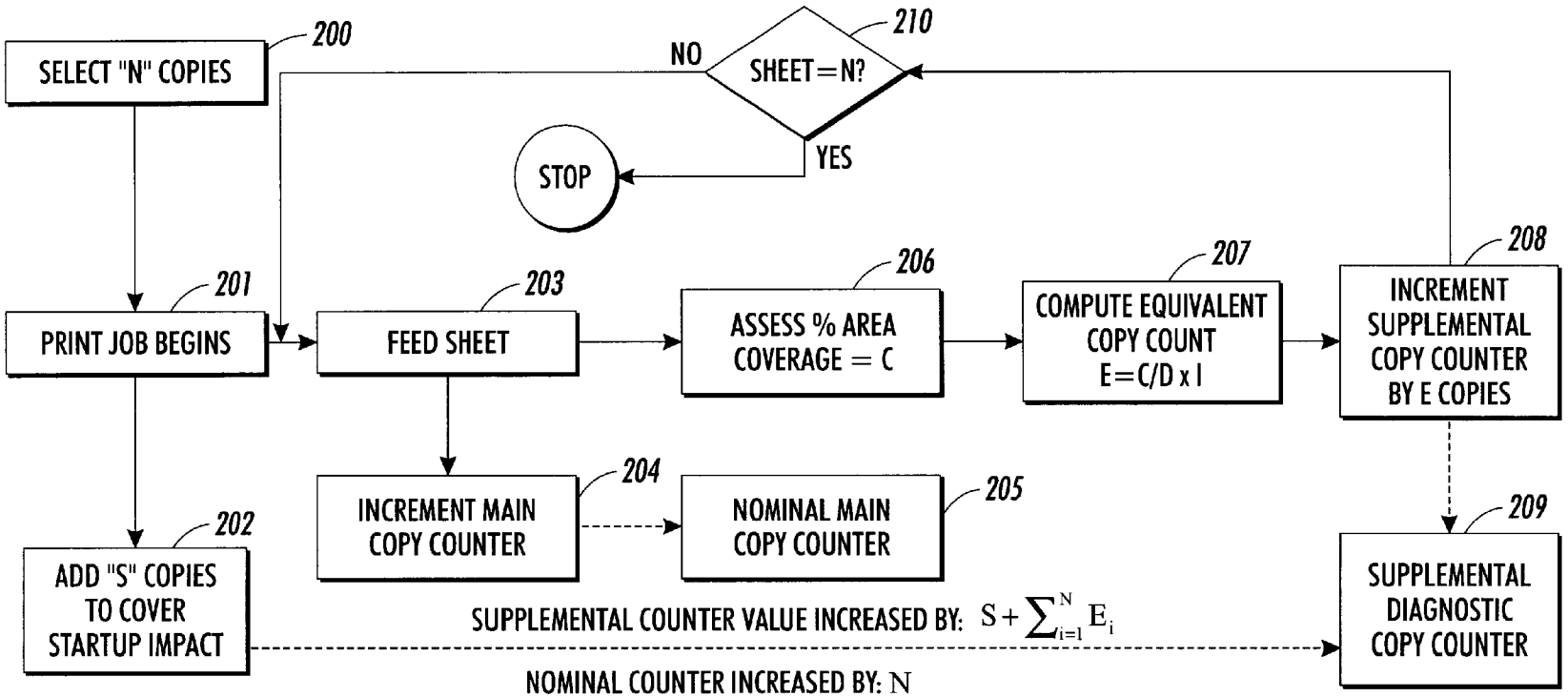
FIG. 2 depicts the a flow diagram for the process flow for smart copy count correction showing startup factor and percent area coverage factors.

FIG. 2 depicts the process flow for smart copy count correction showing the accommodation of startup and percent-area-coverage usage factors in a copier embodiment. Starting with block 200, user input determines a selection of some initial number of copies "N". Then as depicted at block 201 the print job begins. An increment of "S" copy clicks as shown at block 202 is included to cover the startup impact. The number "S" may be ten as discussed above, however, this is machine dependent and will, therefore, vary from system to system. Concurrent with the startup impact increment of block 202, the print job will request the appropriate number of sheet feeds 203. Each sheet feed will increment the nominal main copy counter 205 as is shown at step 204. The sheet feed block 203 will then initiate an assessment of the percentage-area-coverage for the data being printed on that sheet as shown in step 206. In step 207, depending on whether the area coverage is above or below the nominal for a typical print sheet, an equivalent copy count number is generated. One approach to determination of this "E" equivalent copy count number is to take "C" the measured coverage, divide by "D" the nominal default coverage, and then multiply by "I" an influence factor which is empirical in nature.

The equivalent copy count number "E" once determined is used to increment a supplemental copy counter 208. A final supplemental diagnostic copy counter 209 is updated in count by both the supplemental copy counter 208 and the startup impact increment of block 202 to yield a much more robust and meaningful indicator of CRU and HFSI wear replacement scheduling in a document processing system. The supplemental copy counter 208 also toggles decision block 210 where a comparison between the sheet counter and the print job copy number "N" is used to determine if the print job has stopped or if the counter should be decremented and a sheet feed command issued to block 203 to repeat the above described sequence until the job is done.

In closing, by employing supplemental counters and inputting both additional startup/rundown considerations as well as weighting factored counts into the counters, allows a resulting greater accuracy in determining and thereby predicting component end of life wear time. Furthermore, application of this methodology will allow appropriate replacement schedules to be instituted and updated which minimize both cost and customer down time.

While the embodiments disclosed herein are preferred, it will be appreciated from this teaching that various alternative, modifications, variations or improvements therein may be made by those skilled in the art. For example, it will be understood by those skilled in the art that the teachings provided herein may be applicable to many types of document processing systems including copiers, printers and multifunctional scan/print/copy/fax machines with computer, fax, local area network, and Internet connection capability. Further, the techniques herein described above may be applied to many different subsystems in the prior listed document processing systems. All such variants are intended to be encompassed by the following claims:

What is claimed is:

1. A method for assessing an end of life determination for a replaceable element in a system comprising:

accepting a system cycle as a nominal count;

applying at least one weighting factor to the nominal count to yield at least one weighted count; and summing one or more weighted counts into a supplemental diagnostic counter.

2. The method of claim 1 wherein the system is a document processing system.

3. The method of claim 2 wherein the at least one weighting factor further comprises a weighting for environmental factors.

4. The method of claim 2 wherein the at least one weighting factor further comprises a weighting for media type.

5. The method of claim 2 wherein the at least one weighting factor further comprises a weighting for job type.

6. The method of claim 2 wherein the at least one weighting factor further comprises a weighting for job run length.

7. The method of claim 2 wherein the at least one weighting factor further comprises a weighting for job startup conditions.

8. The method of claim 2 wherein the at least one weighting factor further comprises a weighting for image type conditions.

9. A method for assessing end of life determinations for high frequency service items in a document processing system comprising:

accepting a document processing system cycle as a nominal count;

applying at least one weighting factor to the nominal count to yield at least one weighted count; and summing the one or more weighted counts into a supplemental diagnostic counter.

10. The method of claim 9 wherein the high frequency service item is a customer replaceable unit.

11. The method of claim 10 wherein customer replaceable unit has a customer replaceable unit monitor.

12. The method of claim 11 wherein the supplemental diagnostic counter resides in the document processing system.

13. The method of claim 11 wherein the supplemental diagnostic counter resides in the customer replaceable unit monitor.

14. The method of claim 13 wherein the at least one weighting factor further comprises a weighting for environmental factors.

15. The method of claim 13 wherein the at least one weighting factor further comprises a weighting for media type.

16. The method of claim 13 wherein the at least one weighting factor further comprises a weighting for job type.

17. The method of claim 13 wherein the at least one weighting factor further comprises a weighting for job run length.

18. A method for assessing end of life determinations for a high frequency service item in a document processing system comprising:

incrementing a nominal counter by a nominal count for each cycle of the document processing system;

applying at least one weighting factor to the nominal count to yield a weighted count; and summing the nominal count and the weighted count into one or more supplemental diagnostic counters.

19. The method of claim 18 wherein the high frequency service item is a customer replaceable unit.

20. The method of claim 19 wherein customer replaceable unit has a customer replaceable unit monitor.

21. The method of claim 20 wherein the supplemental diagnostic counter resides in the document processing system.

22. The method of claim 20 wherein the supplemental diagnostic counter resides in the customer replaceable unit monitor.

23. The method of claim 22 wherein the at least one weighting factor further comprises a weighting for environmental factors.

24. The method of claim 22 wherein the at least one weighting factor further comprises a weighting for media type.

25. The method of claim 22 wherein the at least one weighting factor further comprises a weighting for job type.

26. The method of claim 22 wherein the at least one weighting factor further comprises a weighting for job run length.

* * * * *